US006181296B1

(12) United States Patent
Kulisan et al.

(10) Patent No.: US 6,181,296 B1
(45) Date of Patent: Jan. 30, 2001

(54) CAST CORE FABRICATION OF HELICALLY WOUND ANTENNA

(75) Inventors: Charles W. Kulisan; William E. Clark, both of Palm Bay; Robert J. Guinn, Jr., Melbourne; Gilbert R. Perkins, Palm Bay, all of FL (US)

(73) Assignee: Harris Corporation, Melbourne, FL (US)

( * ) Notice: Under 35 U.S.C. 154(b), the term of this patent shall be extended for 0 days.

(21) Appl. No.: 09/182,073

(22) Filed: Oct. 29, 1998

(51) Int. Cl.[7] ..... H01Q 1/36
(52) U.S. Cl. ..... 343/895; 343/745; 29/600
(58) Field of Search ..... 343/895, 749, 343/745, 860, 702, 850; 29/600; H01Q 1/36

(56) References Cited

U.S. PATENT DOCUMENTS

| | | | | |
|---|---|---|---|---|
| 4,862,184 | | 8/1989 | Ploussios | 343/895 |
| 5,329,287 | | 7/1994 | Strickland | 343/752 |
| 5,341,149 | * | 8/1994 | Valinaa et al. | 343/895 |
| 5,604,972 | | 2/1997 | McCarrick | 29/600 |
| 5,914,697 | * | 6/1999 | Seki | 343/895 |
| 5,973,646 | * | 10/1999 | Engblom | 343/702 |
| 5,977,931 | * | 11/1999 | Openlander | 343/895 |
| 5,986,607 | * | 11/1999 | Rudisill | 343/702 |

* cited by examiner

*Primary Examiner*—Hoanganh Le
(74) *Attorney, Agent, or Firm*—Allen, Dyer, Doppelt, Milbrath & Gilchrist, P.A.

(57) ABSTRACT

A cast core process is used to fabricate a very small, precision wound helical antenna having readily repeatable configuration parameters for use in a high GHz multi-element (e.g., phased array) antenna. A dielectric core member is formed by shaping a solid mandrel having a precision helical groove. After a mold is formed around the mandrel and cured, the mandrel is extracted, so that it may be used to make additional identical molds. A dielectric mixture is injected into the mold's cavity, and cured. The mold is then removed, and antenna wire is tightly wound and bonded into the dielectric core's helical groove. The antenna wire-wrapped core is then mechanically and electrically attached to a baseplate laminate structure, that includes a tuning circuit, so that the antenna may be physically mounted to a support member and connected to an associated transmit—receive module.

14 Claims, 2 Drawing Sheets

CAST CORE FABRICATION OF HELICALLY WOUND ANTENNA

FIELD OF THE INVENTION

The present invention relates in general to the manufacture and assembly of helical antennas for very high frequency applications (e.g., several tens of GHz), and is particularly directed to a cast core-based fabrication of a very small precision wound helical antenna having readily repeatable configuration parameters for use in a phased array antenna.

BACKGROUND OF THE INVENTION

Continuing improvements in circuit manufacturing technologies in developing smaller sized components for achieving higher operational frequencies (smaller wavelengths) has been accompanied by a need to reduce the dimensions of both signal processing and interface circuitry support hardware and their associated radio frequency antenna structures. In such reduced size, high frequency communication systems, helically wound antennas, such as those supported by low loss foam cores, are particularly attractive, as their radiation characteristics and relatively narrow physical configurations readily lend themselves to implementing physically compact phased array architectures that provide for electronically controlled shaping and pointing of an antenna's directivity pattern.

However, as operational frequencies have reached into the multidigit GHz range, achieving dimensional tolerances in large numbers of like components has become a major challenge to system designers and manufacturers. For example, in a relatively large number element phased array antenna operating at frequency in a range of 15–35 GHz, and containing several hundred to a thousand or more antenna elements, each antenna element may have on the order of twenty turns helically wound within a length of only several inches and a diameter of less than a quarter of an inch.

While conventional fabrication techniques, such as those which employ crossed-slat templates, diagrammatically illustrated in FIG. 1 at 11 and 12 to form a winding 14, may be sufficient to form helical windings for relatively large sized applications (since relatively small variations in dimensions or shape may not significantly degrade the electrical characteristics of the overall antenna), they are inadequate for very small sized elements (multi-GHz applications), where minute parametric variations are reflected as substantial percentage of the dimensions of each element. As a consequence, unless each element is effectively identically configured to conform with a given specification, there is no assurance that the antenna will perform as intended. This lack of predictability is essentially fatal to the successful manufacture and deployment of a high numbered multi-element antenna structure, especially one that may have up to a thousand elements.

SUMMARY OF THE INVENTION

In accordance with the present invention, the drawbacks of using conventional helical antenna fabrication techniques for high frequency designs are effectively obviated by a precision cast core-based manufacturing process to construct any number of very small helically wound antenna elements, each of which has readily repeatable configuration parameters. Pursuant to the invention, a dielectric core member upon which the helical antenna is wound is formed by shaping a solid mandrel to conform with the intended contour of the core member, and such that the eventually realized core member provides the intended characteristic impedance of the antenna. In addition, a precision helical groove is machined in the surface of the mandrel, to a shape and depth that provide for precision seating of the antenna wire that is wound around the dielectric core member.

After machining the mandrel to its intended shape, a silicone mold is formed around the mandrel and cured. The mandrel is then extracted, leaving the silicone mold with a shaped cavity having an embossed helical ridge that replicates the shape of the groove in the mandrel. The mandrel may now be repeatedly used to make additional dielectric cores of the identical shape and dimensions. A dielectric core epoxy—glass bead mixture is then injected into the silicone mold's cavity, and cured.

The silicone mold is then removed, and a length of antenna wire that is slightly longer than the length of helical groove is tightly wound in the dielectric core's helical groove, leaving wire extensions that project from the base and distal ends of the core. The antenna wire is then adhesively secured in the core groove at selected locations, thereby realizing a dielectric core-supported helical winding that is dimensionally stable, conforming exactly with the precision helical groove machined in the outer surface of the original mandrel.

The antenna wire-wrapped core is then mechanically and electrically attached to a baseplate laminate structure, so that the antenna may be physically mounted to a support member and connected to an associated transmit—receive module. The baseplate laminate structure includes a microstrip tuning circuit connected between the feed end of the helical antenna wire and the center pin of a standard self-mating connector, which provides a direct low loss connection to the transmit—receive module.

DETAILED DESCRIPTION

Figure 1:
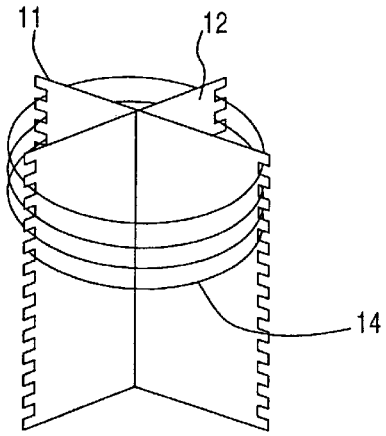
FIG. 1 (PRIOR ART)
FIG. 1 diagrammatically illustrates the conventional use of a pair of crossed-slat templates for forming a relatively large sized, low frequency helical antenna.
Figure 2:
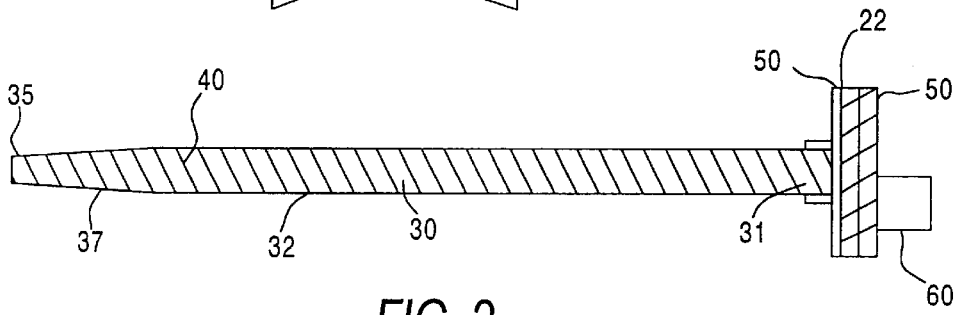
FIG. 2 is a diagrammatic perspective side of the configuration of a precision, cast core-wound helical antenna in accordance with the present invention.

A precision helical antenna manufactured in accordance with the cast core-based fabrication scheme of the present invention is diagrammatically shown in the side view of FIG. 2 as comprising an integrated arrangement of a cup structure 20, a baseplate 22, dielectric core member (or simply core) 30, a multiturn conductive helix 40, a tuning circuit 50 for the antenna, and a (self-mating) connector 60.

Figure 3:
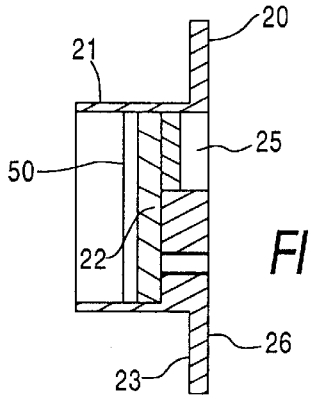
FIGS. 3 and 4 are respective end and side views of a cup structure base plate in which the helical antenna of FIG. 2 is inserted.
Figure 4:
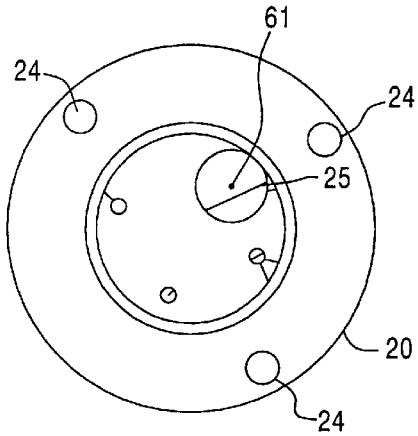

The cup structure 20, which is shown in greater detail in the end view of FIG. 3 and the side view of FIG. 4, provides mechanical support for each of the baseplate 22, dielectric core member 30 and helical winding 40, and antenna tuning circuit 50. The cup structure 20 and the baseplate 22 are made of conductive material, such as aluminum plated with thin nickel and gold layers. In cross-section the cup structure 20 has a generally inverted cylindrical 'T' shape, defined by a generally hollow, centrally located cylindrical cup 21, which projects from a generally flat circular plate member 23. A plurality of mounting holes 24 are formed through the plate member 23 and are sized to receive fasteners such as screws and the like for affixing the baseplate to the cup structure. A blind or self-mate connection through-hole 25 is formed in plate member 23 at the bottom of the cup 21 for providing attachment of the antenna tuning circuit 50 to an associated transmit—receive module.

Figure 5:
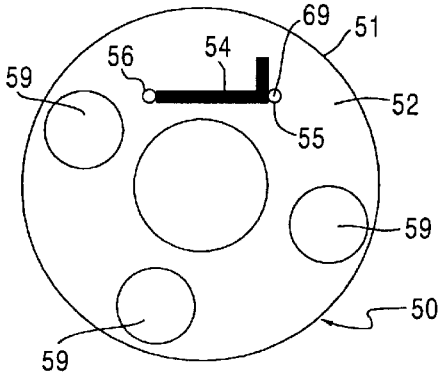
FIG. 5 shows a microstrip-configured tuning circuit for the helical antenna of FIG. 2.
Figure 2A:
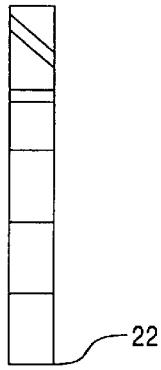
FIGS. 2A and 2B are respective side and end views of a baseplate of the helical antenna of FIG. 2.
Figure 2B:
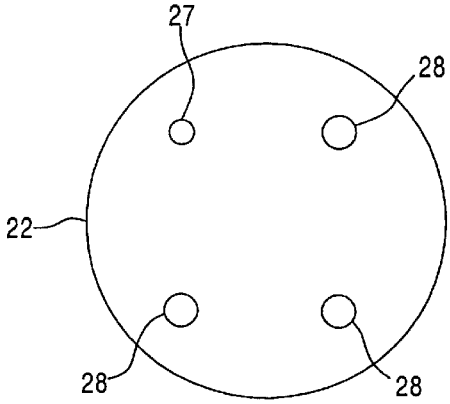

As shown in FIG. 5, the tuning circuit 50 is formed of a generally circular laminate structure comprised of a thin dielectric substrate 51, such as a 0.01 inch thick Rogers 6002 substrate, upon a first side 52 of which a layer of (half-ounce) rolled metallic (e.g., copper) foil 53 is formed. The metallic foil layer is selectively etched to form a microstrip tuning element 54, such as a quarter-wave transformer that extends from a feed port 55 to a connection port 56.

An attachment layer, such as a layer of 0.002 inch thick (acrylic) adhesive film, having a protective backing layer, is attached to the unplated side of the dielectric substrate 51. Mounting holes are drilled through the tuning circuit laminate 50 to be aligned with the through holes 28 in the baseplate. A 0.020 inch diameter hole 69 is drilled through the tuning circuit laminate 50, to provide access to the feed port 55 for the multiturn conductive helix 40. The tuning circuit laminate 50 is attached to the top of the baseplate 22 by means of the adhesive layer 55, after the protective backing layer is peeled off the adhesive film, and the tuning circuit 50 is aligned with the baseplate 22, by pressing the two components together.

The feed port 55 of the tuning circuit 50 is connectable to a conductive pin 61 of a standard (GPO shroud) self-mating connector 60, so as to facilitate a direct low loss connection to the transmit—receive module. The connection may be effected by a conductive ribbon (e.g., a 0.002 inch thick by 0.010 inch wide by 0.020 inch long gold ribbon) that extends from the end of the pin 61 to the microstrip tuning element 54. The tuning circuit 50 may be attached to the GPO connector 60 by any conventional means, such as solder, thermo-compression, welding, and the like. Once the ribbon connector is attached, a portion of the input side of the tuning circuit, such as a length of 0.020 inch of the etched tuning circuit trace, as a non-limiting example, is pre-tinned for attachment to the antenna's helical wire 40.

The dielectric support member 30, upon which the multiturn conductor 40 is helically wound and supported, comprises a generally cylindrically shaped elongated dielectric core member or rod 30, having a feed or base end 31, that is glued to the baseplate 22, using a suitable epoxy adhesive, such as Hysol 9320 epoxy. While the major length portion 33 of the dielectric rod 30 has a constant diameter cylindrical shape, the distal end 35 of the rod 30 terminates with a slight taper, as shown at 37 in the side view of FIG. 2. Extending along a helical path formed in the outer surface 34 of the dielectric core member 30, including both the major length portion 33 and the tapered portion 37 of the rod, is a precision formed groove 32, that serves as support path or track for the conductive winding 40 of the antenna element.

Figure 6:
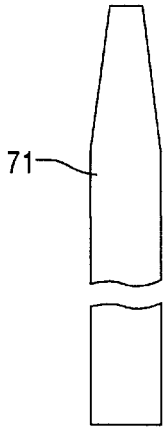
FIGS. 6–11 diagrammatically illustrate the precision, cast core-wound helical antenna element of FIG. 2 at respective stages of its manufacture.

As described briefly above, the dielectric core member 30 is formed by a cast process diagrammatically illustrated in FIGS. 6–11, to realize a very small precision wound helical antenna, that has readily repeatable configuration parameters. For this purpose, as shown in FIG. 6, a solid mandrel 71, such as a cylindrical aluminum rod, is shaped (e.g., by machining) to conform with the intended elongated, partially tapered cylindrically elongated shape of the dielectric core member 30 shown in FIG. 2. As described above, the dimensions of the mandrel are based upon the dielectric properties of the material used in casting the dielectric core member 30, so that the eventually realized core provides the requisite characteristic impedance and resonant frequency for the helical antenna.

Figure 7:
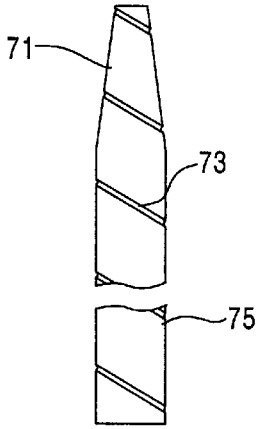

In addition to shaping the mandrel to provide the taper at its distal end, a precision helical groove 73 is formed (e.g., machined) in the outer surface 75 of the mandrel, as shown in FIG. 7. The shape and depth of the helical groove 73 are defined in accordance with the cross-sectional characteristics of the wire to be used for the helical winding 40 (e.g, #31 AWG wire, as a non-limiting example). To provide for precision seating of the wire within the helical groove 73, the groove may be formed in the mandrel surface 75 up to a depth of half the diameter of the antenna wire.

Figure 8:
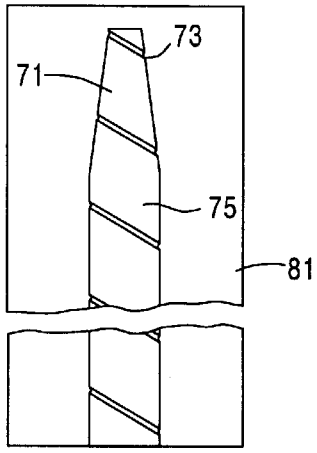
Figure 9:
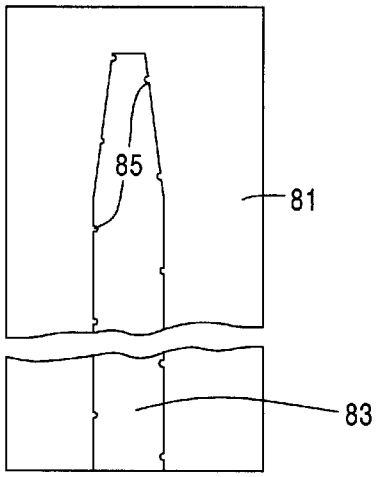

Next, as shown in FIG. 8, a cast or mold 81 (such as, but not limited to a silicone mold) is formed around the mandrel 71. After the mold 81 has cured, the mandrel 71 is extracted, thereby leaving the mold with a shaped cavity 83 having an embossed helical ridge 85 that replicates the shape of the groove 73 in the mandrel 71, as shown in FIG. 9. The mandrel 71 is now available for use in making another mold.

Figure 10:
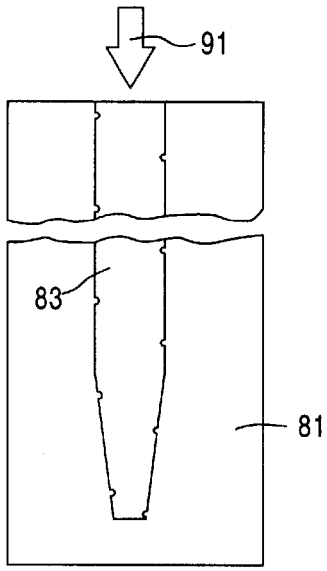

Next, as shown in FIG. 10, a dielectric core epoxy—glass bead mixture 91, such as Emerssen and Cummings Eccospheres Grade SI, Shell Epon 828 epoxy, and SmoothOn Senite 19 hardener, is injected into the mold cavity 81, and allowed to cure. As a non-limiting example, this glass epoxy mixture of may be cured at a temperature on the order of 65° C. for 90 minutes. After the dielectric core mixture 91 has cured—to realize the dielectric core member 30 containing the helical groove 32 that replicates the helical ridge 85 of the mold cavity 83—the mold 81 is removed.

Figure 11:
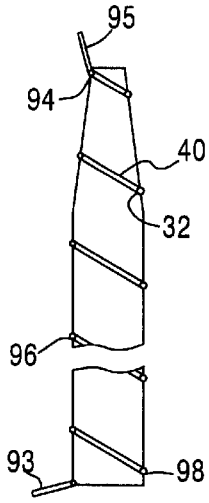

As shown in FIG. 11, antenna wire 40 is then tightly wound in the dielectric core's helical groove 32, leaving extra lengths of wire 93 and 95 projecting from the base end the distal end of the dielectric core member 30. The antenna wire is then tacked in place at selected locations within the core groove 32. For example, the antenna wire may be tacked at top, middle and bottom locations 94, 96 and 98, by a suitable curable adhesive, such as Hysol 9320 epoxy, and cured for 60 minutes, at 80° C., as a non-limiting example, thereby securely bonding the antenna wire to the helical groove and thereby retaining the antenna wire 40 around the dielectric core member 30 in a helical shape that conforms exactly with the precision helical groove 32 around the core.

The wire-wrapped dielectric core member 30 may be readily attached to the baseplate 22 by means of a suitable adhesive, such as Hysol 9320 epoxy, referenced above. When attaching the base end of the dielectric core member 30 to the baseplate 22, the core member may be rotated at an angle on the order of 45° counter clockwise, as viewed from the tapered, distal end of the dielectric core member. The epoxy adhesive may be cured at a temperature on the order of 80° C. for 60 minutes.

The extension length 93 of the antenna wire 40 at the base end of the dielectric core member 30 is pulled taut over the connection port 56 of the tuning circuit 50, so that it is flush with the tuning circuit substrate 51, and overlaps the connection port 56 by a prescribed distance (e.g., 0.020 inches). It is then cut and soldered in place. The extension length of wire 95 at the distal end 35 of the core member is trimmed, so that it terminates with the distal end of the helical groove 32.

The completed helical antenna, shown in FIG. 2, is readily mountable to an associated antenna system support structure, such as a phased array mounting plate, by means of suitable fasteners inserted through mounting holes 24 in the plate member 23, and associated holes in the mounting plate, and with the GPO self-mating connector 60 extending through an associated aperture in the mounting plate for connection to an antenna interface port of the transmit receive module. As pointed out above, because the cast core process of the invention ensures repeatability of the dimensional parameters of each helical winding and its supporting dielectric core member, it is particularly useful in constructing a high frequency phased array antenna (e.g., one operating in a frequency range of 15-35 GHz), containing several hundred to a thousand or more helical antenna elements, each of which may have a pitch on the order of less than an eighth of an inch.

While we have shown and described an embodiment in accordance with the present invention, it is to be understood that the same is not limited thereto but is susceptible to numerous changes and modifications as are known to a person skilled in the art, and we therefore do not wish to be limited to the details shown and described herein, but intend to cover all such changes and modifications as are obvious to one of ordinary skill in the art.

What is claimed is:

1. A method of manufacturing a helical antenna comprising the steps of:

(a) providing a grooved mandrel that conforms with the intended contour of a dielectric support core having a helical groove upon which an antenna conductor is to be wound;

(b) forming a mold around said grooved mandrel, so that said mold conforms with the shape of the surface of said grooved mandrel;

(c) extracting said grooved mandrel from said mold so as to leave said mold with a cavity that has an embossed helical ridge and replicates the shape of said grooved mandrel;

(d) injecting dielectric material into said mold cavity, and curing said dielectric material to produce said dielectric support core;

(e) removing said mold from said dielectric support core produced in step (d); and (f) winding said antenna conductor in said helical groove of said dielectric support core, so as to provide a helical antenna winding that is stably retained by said dielectric support core.

2. The method according to claim 1, further including the step (g) of electrically and mechanically coupling said helical antenna winding as retained by said dielectric support core to a support structure.

3. The method according to claim 2, wherein said support structure includes a tuning circuit that is connectable to a signal interface for said antenna, and wherein step (g) comprises electrically connecting a feed end of said helical antenna winding to said tuning circuit.

4. The method according to claim 3, wherein said support structure includes a conductive baseplate cup structure configured for attachment to an antenna support member, and being laminated with a tuning circuit support structure containing said tuning circuit.

5. The method according to claim 1, wherein said helical groove of said dielectric support core has a pitch associated with an operational antenna frequency lying in multidigit GHz range.

6. A method of manufacturing a multi-element antenna architecture comprising the steps of:

(a) providing a grooved mandrel that conforms with the intended contour of a dielectric support core having a helical groove upon which an antenna conductor is to be wound;

(b) forming a mold around said grooved mandrel, so that said mold conforms with the shape of the surface of said grooved mandrel;

(c) extracting said grooved mandrel from said mold so as to leave said mold with a cavity that has an embossed helical ridge and replicates the shape of said grooved mandrel;

(d) injecting dielectric material into said mold cavity, and curing said dielectric material to produce said dielectric support core;

(e) removing said mold from said dielectric support core produced in step (d);

(f) winding said antenna conductor in said helical groove of said dielectric support core, so as to provide a helical antenna winding that is stably retained by said dielectric support core;

(g) electrically and mechanically coupling said helical antenna winding as retained by said dielectric support core to a support structure for mounting said helical antenna winding to a multi-element antenna support member;

(h) mounting said support structure for said helical antenna winding as retained by said dielectric support core to said multi-element antenna support structure;

(i) repeating steps (a)–(h) a plurality of times, using the grooved mandrel extracted in step (c) as the mandrel provided in repeated step (a).

7. The method according to claim 6, wherein said support structure includes a tuning circuit that is connectable to a signal interface for said antenna, and wherein step (g) comprises electrically connecting a feed end of said helical antenna winding to said tuning circuit.

8. The method according to claim 7, wherein said support structure includes a conductive baseplate cup structure configured for attachment to an antenna support member, and being laminated with a tuning circuit support structure containing said tuning circuit.

9. The method according to claim 6, wherein said helical groove of said dielectric support core has a pitch associated with an operational antenna frequency lying in a range of 15–35 GHz.

10. A helical antenna configured by forming a mold around a helically grooved mandrel that conforms with the intended contour of a dielectric support core having a helical groove upon which an antenna conductor is to be wound, so that said mold conforms with the shape of the surface of said helically grooved mandrel, extracting said helically grooved mandrel from said mold so as to leave said mold with a mold cavity that has an embossed helical ridge and replicates the shape of said helically grooved mandrel, injecting dielectric material into said mold cavity, and curing said dielectric material to Produce said dielectric support core, removing said mold from said dielectric support core, and winding said antenna conductor in said helical groove of said dielectric support core, so as to provide a helical antenna winding that is stably retained by said dielectric support core.

11. The helical antenna according to claim 10, further comprising a support structure to which said helical antenna winding as retained by said dielectric support core is electrically and mechanically coupled.

12. The helical antenna according to claim 11, wherein said support structure includes a tuning circuit that is connectable to a signal interface for said antenna, and wherein a feed end of said helical antenna winding step is electrically connected to said tuning circuit.

13. The helical antenna according to claim 12, wherein said support structure includes a conductive baseplate configured for attachment to an antenna support member, and being laminated with a tuning circuit support structure containing said tuning circuit.

14. The helical antenna according to claim 11, wherein said helical groove of said dielectric support core has a pitch associated with an operational antenna frequency lying in a range of 15–35 GHz.

* * * * *